US012612239B2

(12) United States Patent
Hurrle

(10) Patent No.: US 12,612,239 B2
(45) Date of Patent: Apr. 28, 2026

(54) REUSABLE DISPENSING CONTAINER SYSTEMS

(71) Applicant: VERITY PACKAGING, INC., San Marcos, CA (US)

(72) Inventor: Dave Hurrle, San Marcos, CA (US)

(73) Assignee: Verity Packaging, inc., San Marcos, CA (US)

( * ) Notice: Subject to any disclaimer, the term of this patent is extended or adjusted under 35 U.S.C. 154(b) by 0 days.

(21) Appl. No.: 18/499,813

(22) Filed: Nov. 1, 2023

(65) Prior Publication Data

US 2024/0059477 A1 Feb. 22, 2024

Related U.S. Application Data

(63) Continuation of application No. PCT/US2022/027345, filed on May 2, 2022.

(60) Provisional application No. 63/182,914, filed on May 1, 2021.

(51) Int. Cl.
*B65D 83/761* (2025.01)

(52) U.S. Cl.
CPC ..... *B65D 83/761* (2025.01)

(58) Field of Classification Search
CPC ..... B65D 83/761; B65D 41/3433; B65D 41/3471; B65D 90/545; A45D 40/02; A47G 21/184
See application file for complete search history.

(56) References Cited

U.S. PATENT DOCUMENTS 3,589,821 A * 6/1971 Barney ..... A45D 40/04 401/175
6,939,070 B2 * 9/2005 Butz ..... A45D 40/04 401/175

(Continued)

FOREIGN PATENT DOCUMENTS

EP 0196385 A2 10/1986
EP 0650336 B1 1/1997

(Continued)

OTHER PUBLICATIONS

European Search Report, as issued in connection with European Application No. 22799385.4, dated Feb. 4, 2025, 9 pgs.

*Primary Examiner* — Kareen K Thomas
(74) *Attorney, Agent, or Firm* — Jonathan Spangler; Jay Bell

(57) ABSTRACT

A container system includes a container insert including a material chamber and a number of ridges positioned along the material chamber. The system also includes a driving member engaged with and rotatable relative to the container insert, and a support member is positioned in the material chamber and includes a support surface on which a material in the material chamber may be positioned. A plug member is positioned between the support member and the container insert, and is configured to prevent passage between the support member and the container insert of a material which may be positioned in the material chamber. The support member is engaged with the driving member and movable in the material chamber in response to rotation of the driving member relative to the container insert, and the number of ridges limit rotation of the support member relative to the container insert.

24 Claims, 12 Drawing Sheets

(56) References Cited

U.S. PATENT DOCUMENTS

| | | | | |
|---|---|---|---|---|
| 2007/0000946 | A1* | 1/2007 | Phipps | B65D 83/761 222/129.4 |
| 2009/0321478 | A1* | 12/2009 | Juteau | B65D 83/761 220/288 |
| 2010/0059074 | A1* | 3/2010 | Brantley | A24D 3/0295 348/207.1 |
| 2011/0033220 | A1* | 2/2011 | Arai | A45D 40/04 401/68 |
| 2012/0231125 | A1* | 9/2012 | Orel | B65D 83/761 426/115 |
| 2019/0133298 | A1* | 5/2019 | Bushell | B65D 83/761 |

FOREIGN PATENT DOCUMENTS

| | | | |
|---|---|---|---|
| EP | 0604489 | B1 | 11/1998 |
| WO | 2021/055888 | A1 | 3/2021 |

* cited by examiner

REUSABLE DISPENSING CONTAINER SYSTEMS

CROSS-REFERENCE TO RELATED APPLICATIONS

This application is a continuation of PCT Application No. PCT/US2022/027345, filed on May 2, 2022; which claims the benefit of U.S. Patent Application Ser. No. 63/182,914, filed on May 1, 2021; the disclosures of which are incorporated herein by reference in their entireties.

FIELD

The present disclosure generally relates to containers. More particularly, but not exclusively, the present disclosure relates to reusable dispensing container systems.

BACKGROUND

Unless otherwise indicated herein, the materials described herein are not prior art to the claims in the present application and are not admitted to be prior art by inclusion in this section.

Single use packaging containers and other consumer product containers may lead to increases in the amount of waste provided to landfills and, in turn, the amount of waste which ultimately finds its way into waterways and other natural features. In order to reduce such waste, there is an increasing need to provide reusable packaging containers and related consumer product containers.

The subject matter claimed herein is not limited to implementations that solve any disadvantages or that operate only in environments such as those described above. Rather, this background is only provided to illustrate one example technology area where some implementations described herein may be practiced.

SUMMARY

This Summary is provided to introduce a selection of concepts in a simplified form that are further described below in the Detailed Description. This Summary is not intended to identify key features or essential characteristics of the claimed subject matter, nor is it intended to be used as an aid in determining the scope of the claimed subject matter.

In one embodiment, a container system includes a container insert including a material chamber and a number of elongated projections extending into the material chamber. The system also includes a driving member engaged with and rotatable relative to the container insert, and a support member positioned in the material chamber and including a number of receptacles each corresponding to a respective one of the number of elongated projections. The support member is engaged with the driving member and movable in the material chamber in response to rotation of the driving member relative to the container insert and the number of elongated projections limit rotation of the support member relative to the container insert.

In another embodiment, a container system includes a container insert including a material chamber and a number of ridges positioned along the material chamber; a driving member engaged with and rotatable relative to the container insert; a support member positioned in the material chamber and including a support surface on which a material in the material chamber may be positioned; and a plug member positioned between the support member and the container insert. The plug member is configured to prevent passage between the support member and the container insert of a material which may be positioned in the material chamber. The support member is engaged with the driving member and movable in the material chamber in response to rotation of the driving member relative to the container insert and the number of ridges limit rotation of the support member relative to the container insert.

In yet another embodiment, a container system includes a container insert including a material chamber; a driving member engaged with and rotatable relative to the container insert; a support member positioned in the material chamber and including a support surface on which a material in the material chamber may be positioned; and a plug member positioned between the support member and the container insert, the plug member being configured to prevent passage between the support member and the container insert of a material which may be positioned in the material chamber. The support member is engaged with the driving member and movable in the material chamber in response to rotation of the driving member relative to the container insert.

Additional features and advantages of the invention will be set forth in the description which follows, and in part will be obvious from the description, or may be learned by the practice of the invention. The features and advantages of the invention may be realized and obtained by means of the instruments and combinations particularly pointed out in the appended claims. These and other features of the present invention will become more fully apparent from the following description and appended claims, or may be learned by the practice of the invention as set forth hereinafter.

BRIEF DESCRIPTION OF THE DRAWINGS

To further clarify the above and other advantages and features of the present invention, a more particular description of the invention will be rendered by reference to specific embodiments thereof which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

DETAILED DESCRIPTION

Reference will now be made to the drawings to describe various aspects of example embodiments of the invention. It is to be understood that the drawings are diagrammatic and schematic representations of such example embodiments, and are not limiting of the present invention, nor are they necessarily drawn to scale.

The present disclosure generally relates to containers. In particular, some embodiments relate to container systems which include an outer container and a container insert removably positioned in the outer container. It will be appreciated that embodiments disclosed herein may be employed in a variety of fields and/or operating environments where the functionality disclosed herein may be useful. Accordingly, the scope of the invention should not be construed to be limited to the exemplary implementations and operating environments disclosed herein.

Figure 1:
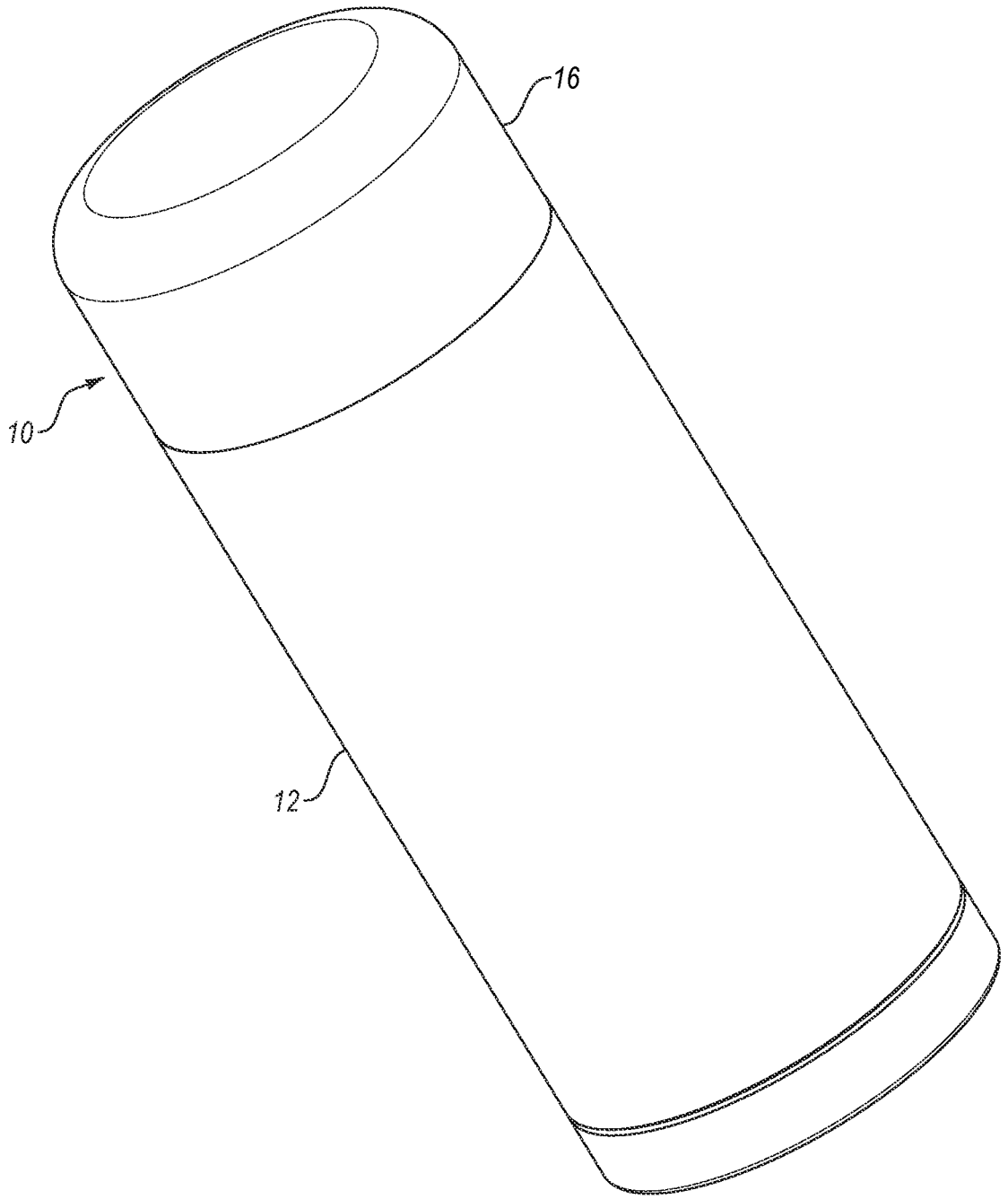
FIG. 1 is a perspective view of a dispensing container system.
Figure 2:
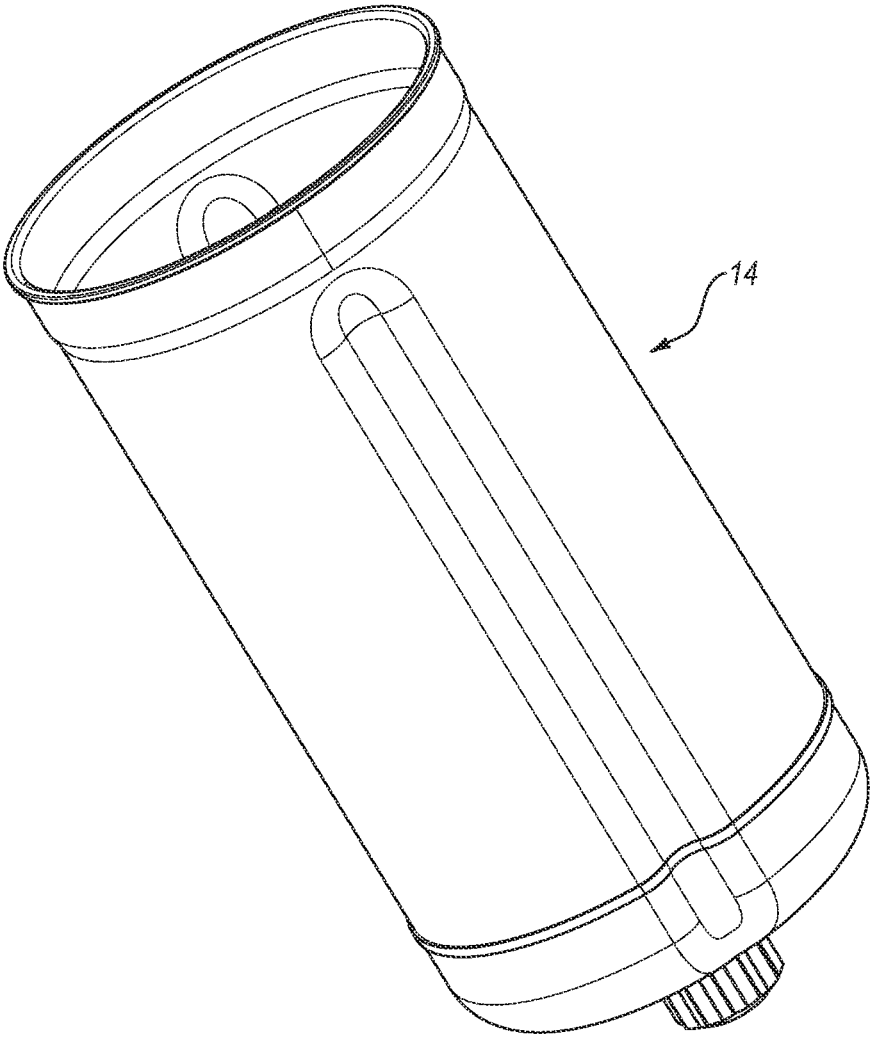
FIG. 2 is a perspective view of a container insert of the container system of FIG. 1.
Figure 3:
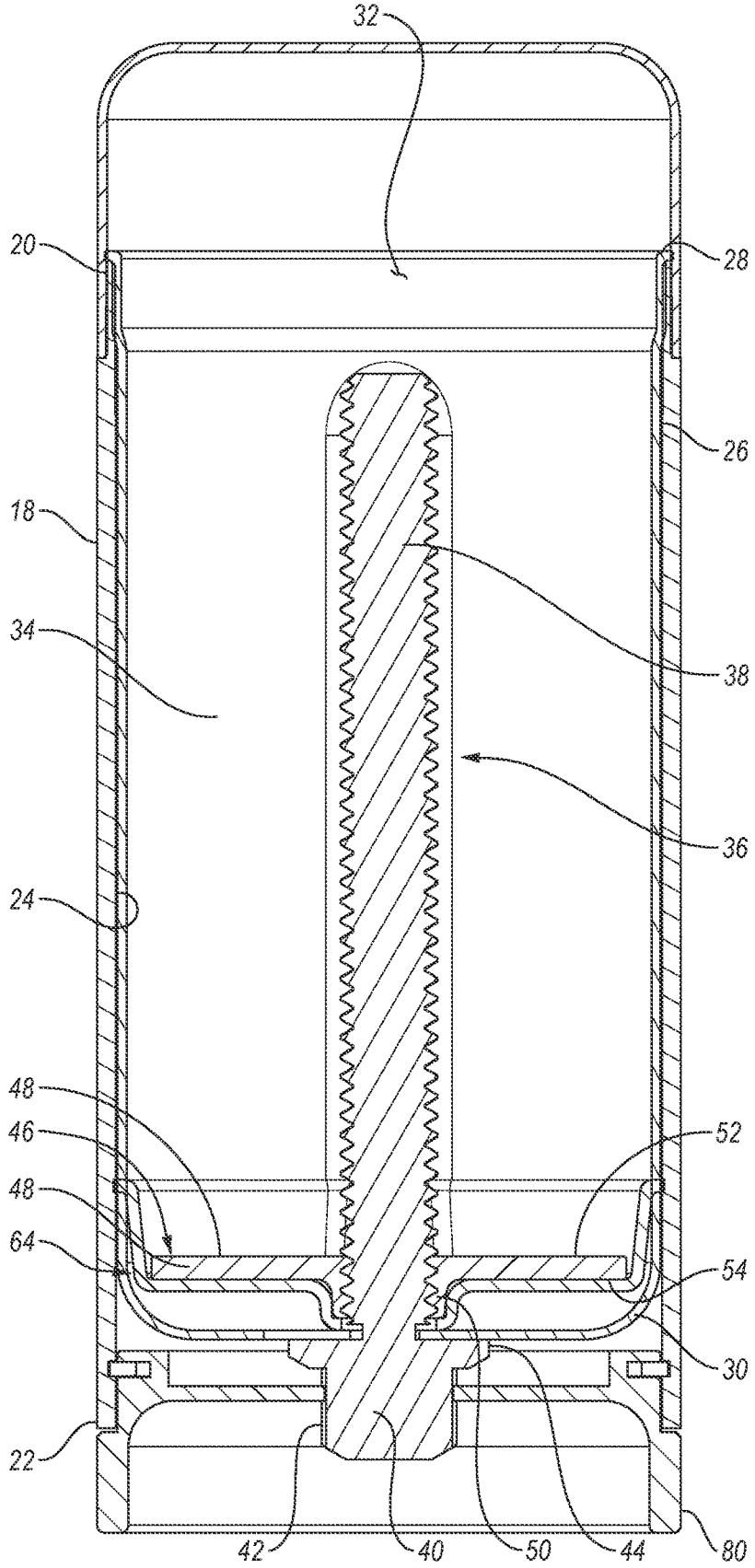
FIG. 3 is a section view of the container system of FIG. 1.

With general reference to FIGS. 1-3 for example, there is illustrated an example embodiment of a container system 10. The container system 10 includes an outer container 12, a container insert 14 which is removably positionable and securable in the outer container 12, and a lid 16 configured to engage with the outer container 12 with or without the container insert 14 being positioned therein.

The outer container 12 includes a container body 18 which extends between a first end 20 and an opposite second end 22. The container body 18 generally includes a cylindrical configuration, although variations in the shape and configuration of the container body 18 are contemplated. An opening at the first end 20 of the container body 18 communicates with and provides access to a hollow interior 24 of the container body 18 in which the container insert 14 may be positioned. The opening at the first end 20 may have a circular or generally circular configuration, although variations are possible. The second end 22 of the container body 18 also includes an opening which is positioned opposite of the opening at the first end 20. The opening at the second end 22 may also communicate with the hollow interior 24.

The container insert 14 includes a container insert body 26 which extends between a first end 28 and an opposite second end 30. The container insert body 26 generally includes a cylindrical configuration, although variations in the shape and configuration of the container insert body 26 are contemplated. An opening 32 at the first end 28 of the container insert body 26 communicates with and provides access to a material chamber or hollow interior 34 which may be configured to store or otherwise hold a material to be dispensed from the container system 10. In one form for example, the material may be a solid material in the form of stick or block which is initially poured or provided in the material chamber 34 in a flowable form, although other variations are possible. The opening 32 may have a circular or generally circular configuration, although variations are possible. In addition, the container insert 14 includes an opening positioned opposite of the opening 32 which extends through the second end 30 of the insert body 26. In one form for example, the opening extending through the second end 30 of the insert body 26 may be smaller than the opening 32 and may have a keyhole or similarly shaped configuration, although variations are possible. For example, in one form, the opening at the second end 30 of the insert body 26 may include a generally circular portion with a slot extending therefrom, and the slot may include a width which is less than the diameter of the generally circular portion.

Figure 3A:
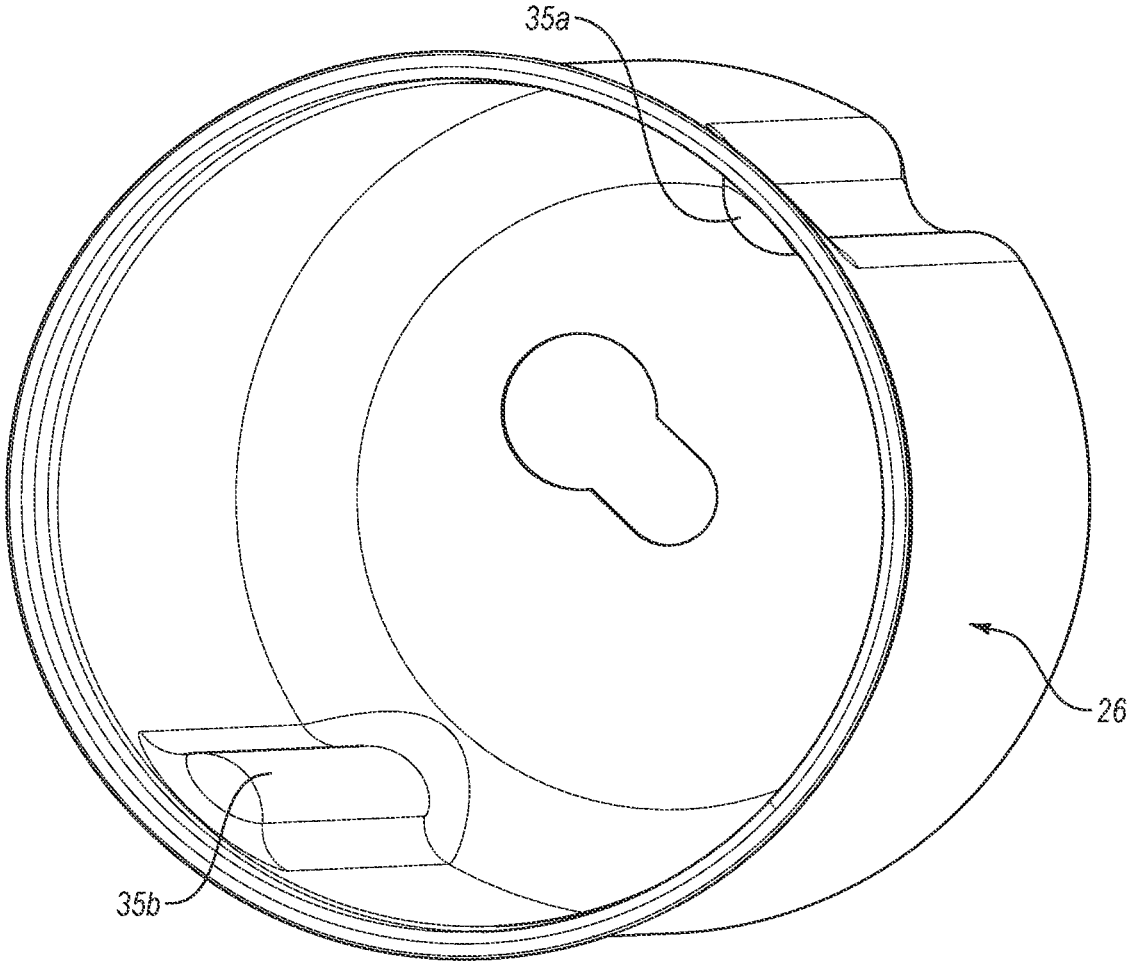
FIG. 3A is an end perspective view of the container insert body of the container insert.
Figure 3B:
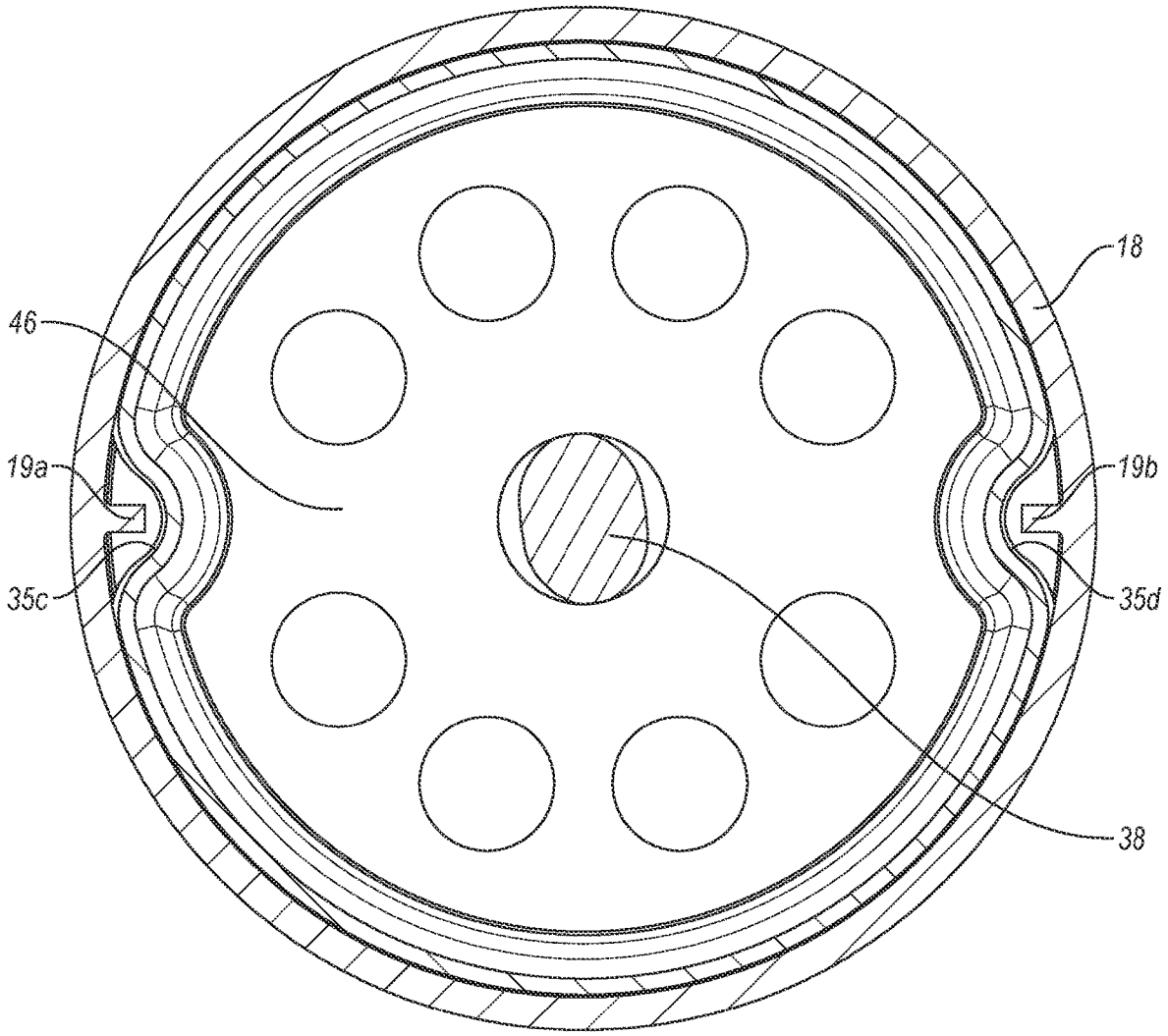
FIG. 3B is an alternative section view of the container system of FIG. 1.

The container insert body 26 also includes a number of elongated projections or ridges 35*a* and 35*b* positioned on a sidewall thereof and extending into the material chamber 34 as best seen in FIG. 3A. In the illustrated form, the container insert body 26 includes only two elongated projections 35*a* and 35*b*, although forms in which only a single elongated projection or more than two elongated projections are provided are also possible. The container insert body 26 also includes a plurality of grooves 35*c* and 35*d* positioned on an external surface thereof and opposite of and corresponding to the elongated projections 35*a* and 35*b* (FIG. 3B).

The container insert 14 also includes a driving member 36 which extends through the opening through the second end 30 of the container insert body 26 such that a portion of the driving member 36 is positioned in the material chamber 34. The driving member 36 includes an externally threaded portion 38 extending from a head portion 40. The head portion 40 may include a hex or other similarly configured portion 42 positioned adjacent to an engagement portion 44 which, when the driving member 36 is engaged with the container insert body 26, bears against the second end 30 of the container insert body 26 opposite of the material chamber 34. The opening through the second end 30 of the container insert body 26 may be sized and structured to facilitate rotation of the driving member 36 relative to the container insert body 26 while also preventing the head portion 40 from passing into the material chamber 34.

The container insert 14 also includes a support member 46 which is engaged with the driving member 36 and provides a support platform for a material stored in the material chamber 34. As will be described in greater detail below, the support member 46 is movable in the material chamber 34 in response to rotation of the driving member 36. As the support member 46 is moved in this manner, a force may be applied to a material stored in the material chamber 34 to push the material toward and/or out of the opening 32 at the first end 20 of the container insert body 26.

Figure 4:
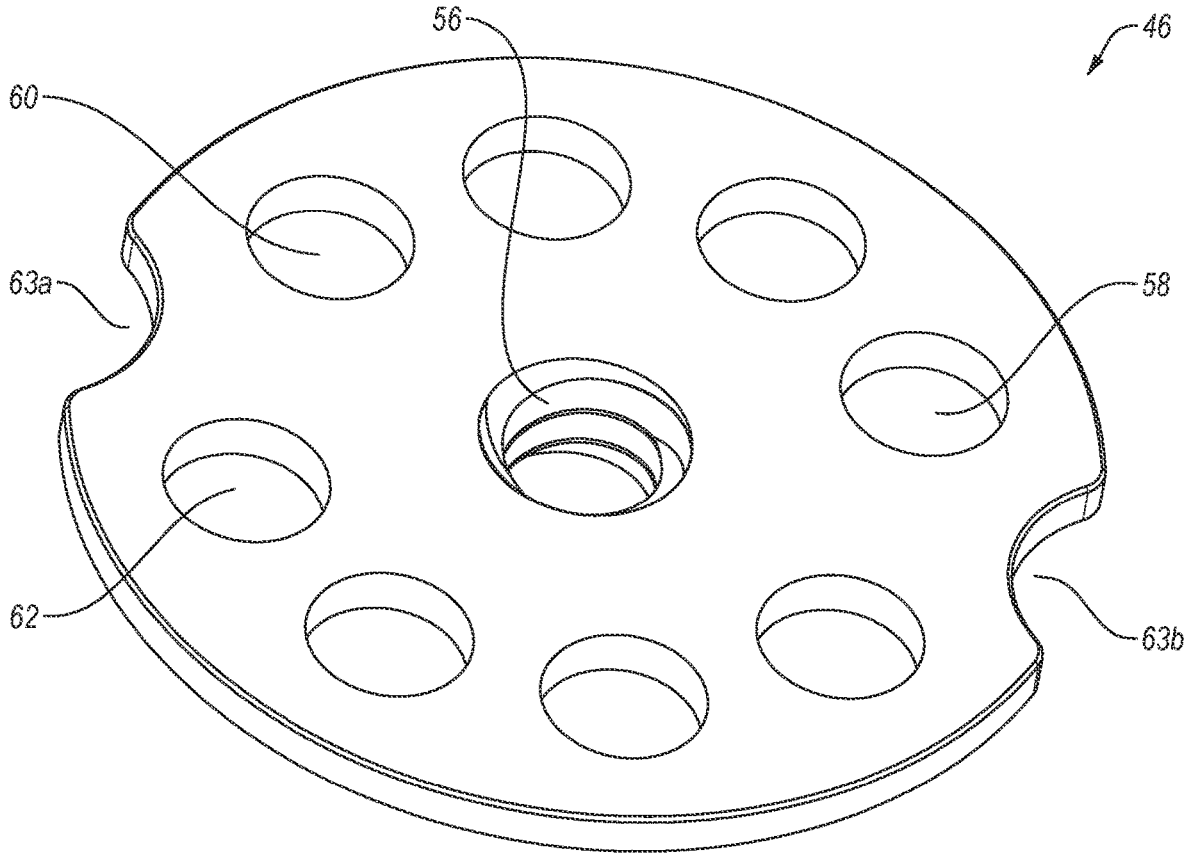
FIG. 4 is a perspective view of a support member in the container insert.

In the illustrated form, the support member 46 includes an upper portion 48 defining a surface which may support a material in the material chamber, and a lower portion 50 which extends from the upper portion 48. As illustrated in FIGS. 3 and 4 for example, the upper portion 48 is generally configured as a round disc, although other shapes and configurations are possible. The upper portion 48 includes an upper surface 52 positioned opposite of a lower surface 54. The upper portion 48 further includes a plurality of apertures 58, 60 and 62 (only a few of which have been numerically identified for the sake of clarity) which are positioned about an internally threaded aperture 56 and extend through the upper portion 48 between the upper surface 52 and the lower surface 54. Forms in which one or more of the apertures 58, 60 and 62 is replaced by an indentation, groove or similar feature that does not extend entirely through the upper portion 48 are also possible and contemplated, as well as forms where the upper portion 48 is flat and does not include any surface features. The upper portion 48 also includes a pair of oppositely positioned recesses or receptacles 63*a* and 63*b* which may generally correspond to the elongated projections 35*a* and 35*b* such that a portion thereof may be positioned in the receptacles 63*a* and 63*b* and limit or prevent rotational movement of the support member 46 relative to the container insert body 26. In alternative forms, the upper portion 48 may include a number of the receptacles 63 which corresponds to the number of the elongated projections 35, although forms in which the numbers thereof are different are also possible.

The upper portion 48 may be sized such that, when positioned in the material chamber 34 as illustrated in FIG. 3 for example, a space extends around the upper portion 48 and a sidewall of the material chamber 34, although other variations are possible. The support member 46 may be formed of a rigid metal, plastic or composite material, just to provide a few non-limiting examples. Forms in which the support member 46 is formed of a semi-rigid or flexible material are also contemplated.

As indicated above, the support member 46 also includes an internally threaded aperture 56. More specifically, the internally threaded aperture is formed in the lower portion 50 of the support member 46. The externally threaded portion 38 of the driving member 36 is configured to engage with the internally threaded aperture 56.

Figure 5:
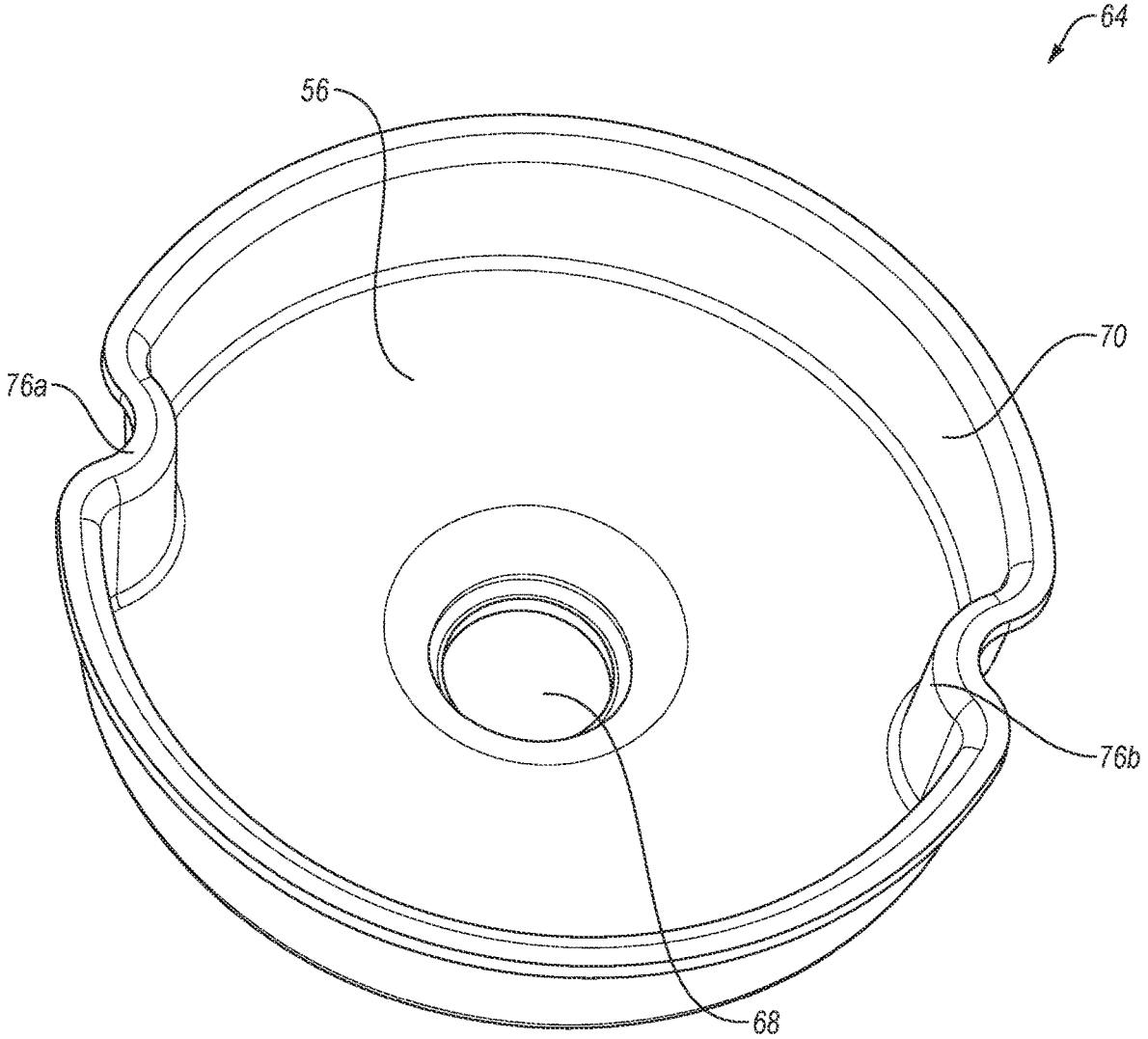
FIGS. 5 and 6 are perspective views of a plug member in the container insert.
Figure 6:
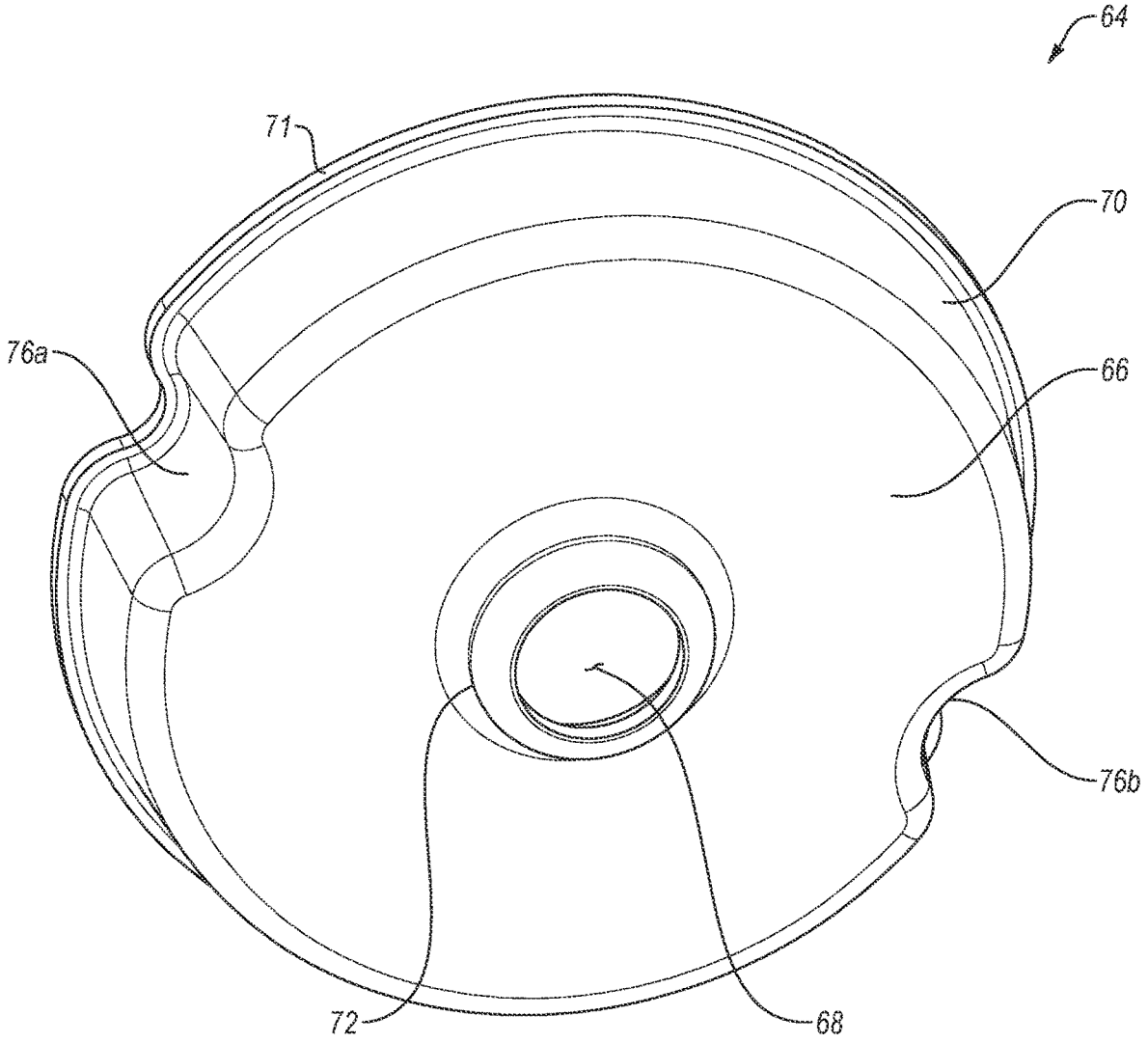

The container insert also includes a plug member 64, further details of which are provided in connection with FIGS. 5 and 6. The plug member 64 has a generally disc-like configuration. More specifically, the plug member 64 includes a central portion 66 having an aperture 68 extending therethrough. The aperture 68 may be configured, for example, to facilitate passage of the driving member 36 through the plug member 64. The plug member 64 also includes a radial flange or sidewall 70 extending from the central portion 66. As best seen in FIG. 3 for example, the sidewall 70 extends obliquely to the central portion 66 in an arrangement where a distance between opposing portions of the sidewall 70 increases as the sidewall 70 moves away from the central portion 66. Similarly, the configuration of the sidewall 70 provides a flared configuration for a portion of the plug member 64. Moreover, in this arrangement, the sidewall 70 may engage with a sidewall of the material chamber 34 at a location spaced above the support member 48. However, forms in which the sidewall 70 is shorter and engages the sidewall of the material chamber 34 at or near the support member 46 are also possible. In addition, while not previously mentioned, the sidewall 70 includes an edge 71 extending laterally therefrom and in some forms the edge 71 may engage against the sidewall of the material chamber 34.

The plug member 64 also includes a cylindrical portion 72 which extends from the central portion 66. The aperture 68 extends through the cylindrical portion 72 such that the driving member 36 may also extend through the cylindrical portion 72. Moreover, the cylindrical portion 72 may be sized and configured to receive the lower portion 50 of the support member 46 therein. In addition, while not previously mentioned, the central portion 66 and the sidewall 70 may be sized such that the upper portion 48 of the support member 46 is received in the plug member 64 as best seen in FIG. 3 for example. Similarly, in this arrangement, the plug member 64 may fill any space between the support member 46 and the container insert body 26 and thereby prevent passage of any material in the material chamber 34 past the support member 46. Forms in which the cylindrical portion 72 is absent are also possible and contemplated.

In one form for example, the cylindrical portion 72 of the plug member 64 and the lower portion 50 of the support member 46 may be sized relative to one another in a fashion providing a press fit arrangement between the plug member 64 and the support member 46. In this arrangement for example, the press fit may result in coupling of these elements together such that the plug member 64 is moved as the support member 46 is moved in the material chamber 34. Additionally or alternatively, the plug member 64 and the support member 46 may be coupled by one or more adhesives, and/or a material which is poured or provided in the material chamber 34 may flow through the apertures of the support member 46 and into contact or communication with the plug member 64 to provide coupling between these elements.

The plug member 64 further includes a number of projections 74*a* and 74*b* formed in the sidewall 70 as well as a number of receptacles 76*a* and 76*b* formed in the sidewall 70 opposite of and corresponding to the projections 74*a* and 74*b*. The projections 74*a* and 74*b* and the receptacles 76*a* and 76*b* may generally correspond to the elongated projections 35*a* and 35*b* such that a portion thereof may be positioned in the receptacles 76*a* and 76*b* and limit or prevent rotational movement of the plug member 64 relative to the container insert body 26. Similarly, a portion of the projections 74*a* and 74*b* may be positioned in the receptacles 63*a* and 63*b* of the support member 46 to transfer the rotation limiting or preventing function from the elongated projections 35*a* and 35*b* to the support member 46. This arrangement may be best seen in FIG. 3B for example. In addition, as shown in this Figure, the container body 18 also includes a pair of projections 19*a* and 19*b* which may extend into the grooves 35*c* and 35*d* of the container insert body 26 in an arrangement limiting or preventing rotation of the container insert body 26 relative to the container body 18.

As suggested above, the plug member 64 may be sized such that at least a portion thereof, like the sidewall 70 or the edge 71 for example, engages or bears against a sidewall of the material chamber 34. In one form for example, the plug member 64 in its natural state may be larger than the material chamber 34 and formed of a flexibly deformable material that yields to the material chamber 34 to provide a press fit therebetween. For example, as the plug member 64 is positioned in the material chamber 34, the sidewall 70 may be inwardly compressed as it engages against the sidewall of the material chamber 34. However, the sidewall 70 may still provide enough outward force toward the sidewall of the material chamber 34 such that a press fit arrangement between the plug member 64 and the material chamber 34 is provided. In one aspect, the press fit may for example prevent passage of a material poured or positioned in the material chamber 34 from passing between the plug member 64 and the sidewall of the material chamber 34. In one form, the plug member 64 may be formed of paper, a paper-based material, rubber, metal, plastic, or other suitable materials.

As indicated above, the support member 46 may be longitudinally moved through the material chamber 34 in response to rotation of the driving member 36 relative to the insert body 26. More specifically, in the illustrated form, the container system 10 also includes a rotation member 80 which is rotatably coupled to (and rotatable relative to) the outer container 12 and configured to engage with the head portion 40 of the driving member 36. In this arrangement, rotation of the rotation member 80 also results in rotation of the driving member 36 relative to the insert body 26. As the driving member 36 is rotated, the arrangement between the support member 46, the plug member 64 and the material chamber 34 prevents rotation of the support member 46 such that the support member 46 may be threadingly advanced along the driving member 36 toward the first end 20 of the insert body 26. Similarly, in this arrangement, when a material is present in the material chamber 34 it may be advanced by the support member 46 toward the first end 28 of the insert body 26 for use.

As the support member 46 is moved across the material chamber 34, it may (along with the plug member 64) provide a closure for a lower portion of the material chamber 34 across a number of different positions. Similarly, as the material in the material chamber 34 is used, advancement of the support member 46 toward the first end 28 will result in a decreased size of the portion of the material chamber 34 which is accessible from the first end 28 of the insert body 26. In addition, while the press fit provided between the plug member 64 and the material chamber 34 may allow advancement of it and the support member 46 toward the first end 28 of the insert body 26 in response to rotation of the driving member 36, it is also contemplated that the press fit between these components will prevent movement of these components away from the first end 28 of the insert body 26 when the driving member 36 is not being rotated.

The lid 16 may be engageable with the outer container 12 utilizing a press fit or threaded configuration, although other variations are possible, and the container insert 14 may be provided with a removable cover.

Figure 7:
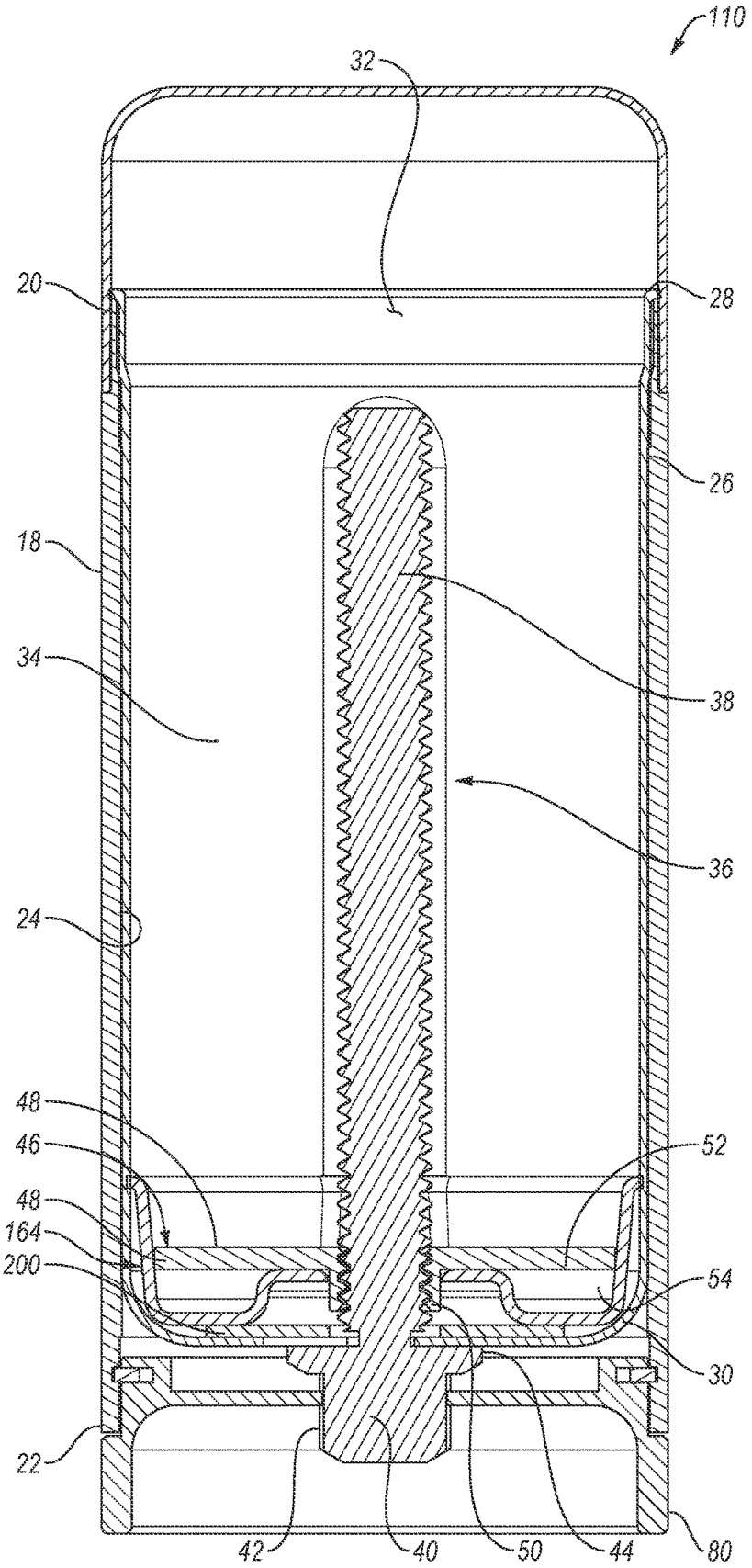
FIG. 7 is a section view of an alternative embodiment container system.
Figure 8:
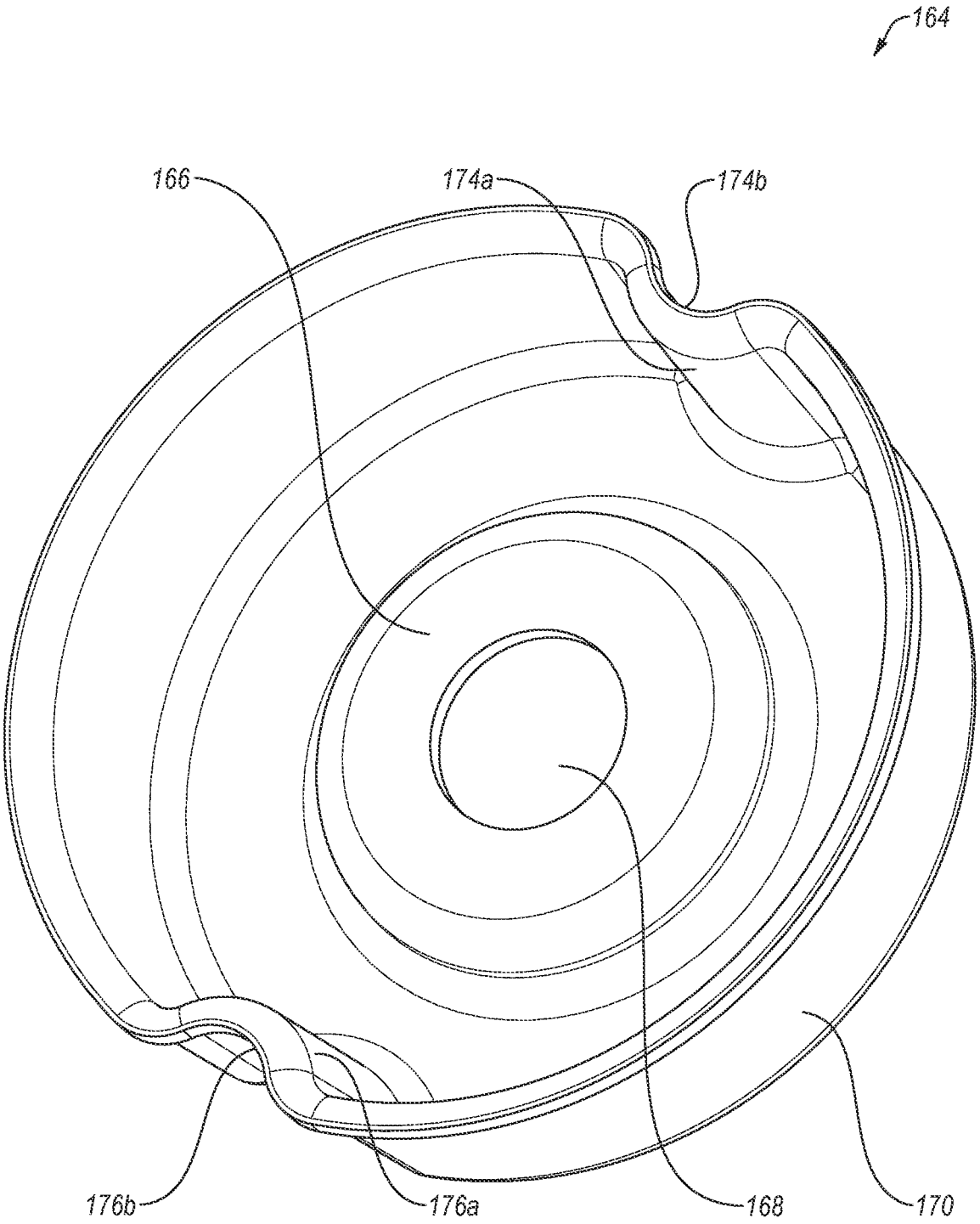
FIGS. 8-9 are perspective views of a plug member of the container system illustrated in FIG. 7.
Figure 9:
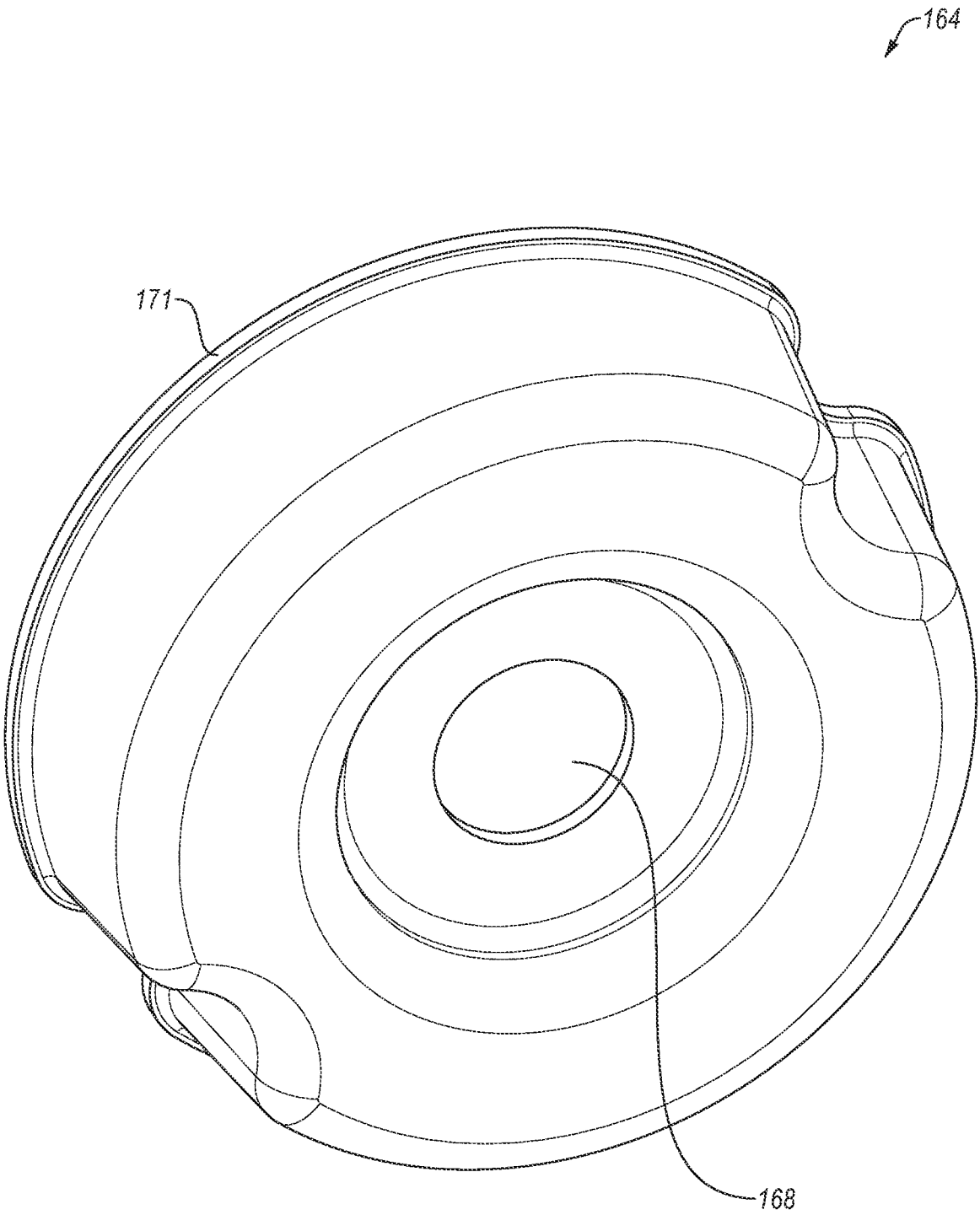

Referring now to FIG. 7, where like numerals refer to like features previously described, there is illustrated in section view an alternative embodiment container system 110. The container system 110 is similar to the container system 10, provided however that the plug member 64 in the container system 10 has been replaced with a plug member 164 in the container system 110. Unless otherwise specified herein, it should be appreciated that the plug member 164 may function the same or substantially similar to the plug member 64, and may otherwise be configured or structured the same or substantially similar to the plug member 64 as described above. In addition to the plug member 164, the container system 110 also includes a blocking member 200. Further details of the plug member 164 and the blocking member 200 are provided below in connection with FIGS. 7-10.

The plug member 164 has a generally disc-like configuration. More specifically, the plug member 164 includes a central portion 166 having an aperture 168 extending therethrough. The aperture 168 may be configured, for example, to facilitate passage of the driving member 36 as well as the lower portion 50 of the support member 46 through the plug member 164. In one form for example, the plug member 164 may include a stem extending therefrom through which the aperture 168 extends thereby defining an elongated receptacle configured to receive the driving member 36 as well as the lower portion 50 of the support member 46.

Figure 10:
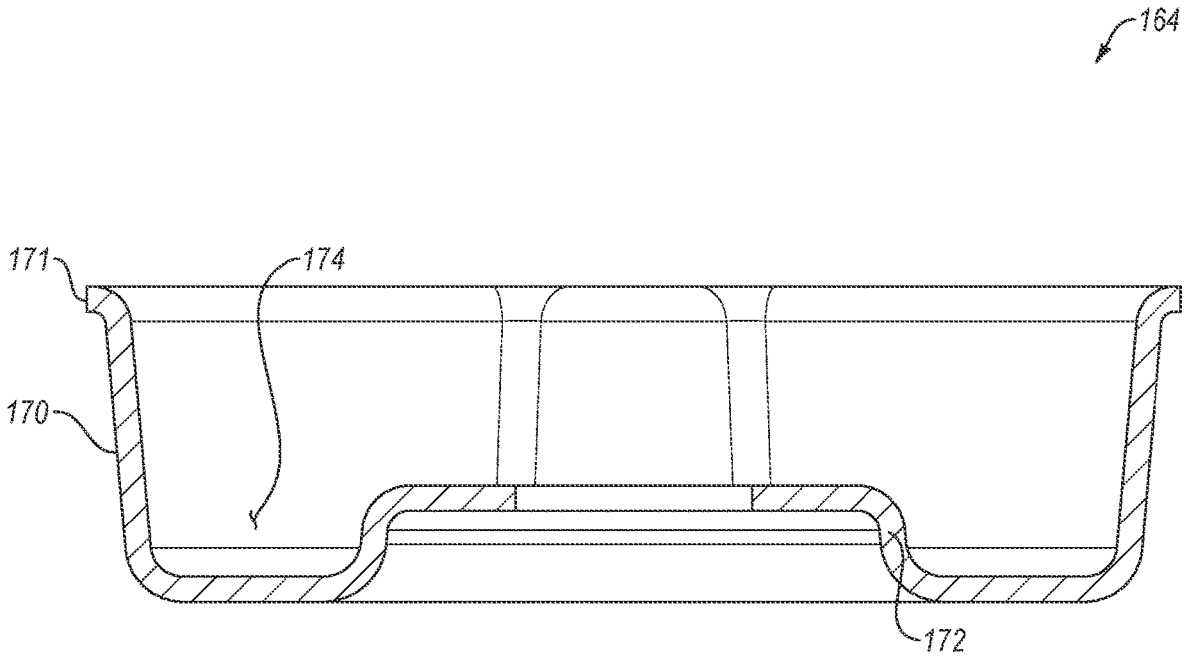
FIG. 10 is a section view of the plug member of the container system illustrate in FIG. 7.

The plug member 164 also includes a radial flange or peripheral sidewall 170 extending from the central portion 166. As best seen in FIG. 10 for example, the peripheral sidewall 170 extends obliquely to the central portion 166 in an arrangement where a distance between opposing portions of the peripheral sidewall 170 increases as the peripheral sidewall 170 moves away from the central portion 166. Similarly, the configuration of the peripheral sidewall 170 may provide a flared configuration for a portion of the plug member 164. Moreover, in this arrangement, the peripheral sidewall 170 may engage with a sidewall of the material chamber 34 at a location spaced above the support member 48. However, forms in which the peripheral sidewall 170 is shorter and engages the sidewall of the material chamber 34 at or near the support member 46 are also possible. In addition, while not previously mentioned, the peripheral sidewall 170 includes an edge 171 extending laterally therefrom and in some forms the edge 171 may engage against the sidewall of the material chamber 34.

The plug member 164 also includes an interior sidewall 172 spaced inwardly of the peripheral sidewall 170 and generally extending around the aperture 168, and a cavity 174 is positioned between the peripheral sidewall 170 and the interior sidewall 172. While not previously mentioned, it should be appreciated the different aspects of the plug member 164 may be integrally formed with one another to provide the plug member 164 with a unitary construction. In addition, while not previously mentioned, the central portion 166 and the peripheral sidewall 170 may be sized such that the upper portion 48 of the support member 46 is received in the plug member 164 as best seen in FIG. 7 for example. In this arrangement, as best seen in FIG. 7 for example, an upper surface of the interior sidewall 172 is positioned on a side of the support member 46 opposite of the upper surface 52 of the upper portion 48 of the support member 46 and an upper portion of the peripheral sidewall 170 extends above the upper surface 52 of the upper portion 48 of the support member 46.

In the illustrated and described arrangement, the plug member 164 may fill any space between the support member 46 and the container insert body 26 and thereby prevent passage of any material in the material chamber 34 past the support member 46. The container system 110 also includes the blocking member 200 which is positioned around the driving member 36 and between the plug member 164 and the second end 30 of the container insert body 26. In this arrangement, if any material should pass between the plug member 164 and the container insert body 26, the blocking member 200 may be configured to prevent passage of such material through the end opening of the container insert body 26 through which the driving member 36 extends. Moreover, the apertures 58, 60 and 62 of the support member 46 may be positioned over the cavity 174 such that material provided in the material chamber may flow or pass through the apertures 58, 60 and 62 and fill the cavity 174. In this arrangement, the positioning of the material through the apertures 58, 60 and 62 and in the cavity 174 may provide enhanced engagement between the plug member 164 and the support member 146.

In one form for example, the aperture 168 of the plug member 164 and the lower portion 50 of the support member 46 may be sized relative to one another in a fashion providing a press fit arrangement between the plug member 164 and the support member 46. In this arrangement for example, and in addition to any coupling provided by material extending through the support member 46 and into the cavity 174 as described above, the press fit may result in coupling of these elements together such that the plug member 164 is moved as the support member 46 is moved in the material chamber 34. Additionally or alternatively, the plug member 164 and the support member 46 may be coupled by one or more adhesives.

The plug member 164 further includes a number of projections 174*a* and 174*b* formed in the peripheral sidewall 170 as well as a number of receptacles 176*a* and 176*b* formed in the peripheral sidewall 170 opposite of and corresponding to the projections 174*a* and 174*b*. The projections 174*a* and 174*b* and the receptacles 176*a* and 176*b* may generally correspond to the elongated projections 35*a* and 35*b* such that a portion thereof may be positioned in the receptacles 176*a* and 176*b* and limit or prevent rotational movement of the plug member 164 relative to the container insert body 26. Similarly, a portion of the projections 174*a* and 174*b* may be positioned in the receptacles 63*a* and 63*b* of the support member 46 to transfer the rotation limiting or preventing function from the elongated projections 35*a* and 35*b* to the support member 46 as described above in connection with FIG. 3B for example.

As suggested above, the plug member 164 may be sized such that at least a portion thereof, like the peripheral sidewall 170 or the edge 171 for example, engages or bears against a sidewall of the material chamber 34. In one form for example, the plug member 164 in its natural state may be larger than the material chamber 34 and formed of a flexibly deformable material that yields to the material chamber 34 to provide a press fit therebetween. For example, as the plug member 164 is positioned in the material chamber 34, the peripheral sidewall 170 may be inwardly compressed as it engages against the sidewall of the material chamber 34. However, the peripheral sidewall 170 may still provide enough outward force toward the sidewall of the material chamber 34 such that a press fit arrangement between the plug member 164 and the material chamber 34 is provided. In one aspect, the press fit may for example prevent passage of a material poured or positioned in the material chamber 34 from passing between the plug member 164 and the sidewall of the material chamber 34. In one form, the plug member 164 may be formed of paper, a paper-based material, rubber, metal, plastic, or other suitable materials.

The container system 110 may be operated in a manner similar to that described above in connection with the container system 10 in order to advance a material in the material chamber 34 toward the first end 28 of the container insert body 26 for use.

In one embodiment, a system container system includes a container insert including a material chamber and a number of elongated projections extending into the material chamber; a driving member engaged with and rotatable relative to the container insert; and a support member positioned in the material chamber and including a number of receptacles each corresponding to a respective one of the number of elongated projections. The support member is engaged with the driving member and movable in the material chamber in response to rotation of the driving member relative to the container insert and the number of elongated projections limit rotation of the support member relative to the container insert.

In one form, the container system further includes a plug member positioned between at least a portion of the support member and the container insert.

In one aspect, the plug member is formed of a flexibly deformable material and provides a friction fit against the container insert.

In another aspect, a portion of the support member is received in a corresponding portion of the plug member or extends through the plug member, and a sidewall of the plug member extends past a surface of the support member on which a material in the material chamber may be positioned.

In still another aspect, the plug member includes an enlarged portion engaging against the container insert.

In yet another aspect, wherein the support member includes a plurality of apertures extending therethrough and into communication with a surface of the plug member.

In a further aspect, the support member includes a plurality of apertures extending therethrough and into communication with a cavity defined by the plug member.

In yet a further aspect, the container system further includes a blocking member positioned around the driving member and between the plug member and an end wall of the container insert.

In another aspect, the plug member is adhered to the support member.

In still another aspect, the plug member includes a receptacle configured to receive a portion of the support member and provide a press fit arrangement between the plug member and the support member.

In another form, the container system further includes a plug member configured to prevent passage of a material in the material chamber between the support member and the container insert.

In one aspect, the plug member includes a number of engagement portions each configured to cooperate with a respective one of the number of elongated projections and a respective one of the number of receptacles of the support member.

In a further aspect, each of the number of engagement portions includes a convex surface and a concave surface, the convex surface being configured to be positioned in a receptacle of the support member and the concave surface being configured to receive a respective one of the elongated projections.

In another aspect, the driving member includes external threading and the support member includes internal threading configured to engage with the external threading.

In still another aspect, the plug member is formed of a paper material.

In yet another aspect, the container system further includes an outer container including a container body extending between a first end and an opposite second end, the container body including a hollow interior communicating with an opening at the first end of the container body and configured to receive the container insert, wherein the container insert includes a generally cylindrical portion and an out-of-round portion positioned adjacent to the generally cylindrical portion and the out-of-round portion is enlarged relative to the generally cylindrical portion and configured to engage with a portion of the container body when the container insert is positioned in the hollow interior of the container body to provide a press fit between the container body and the container insert.

In another form, the container system further includes an outer container including a hollow interior configured to receive the container insert and a rotation member configured to engage with a portion of the driving member extending from container insert, wherein the driving member is rotatable in response to rotation of the rotation member.

In another embodiment, a container system includes a container insert including a material chamber and a number of ridges positioned along the material chamber; a driving member engaged with and rotatable relative to the container insert; a support member positioned in the material chamber and including a support surface on which a material in the material chamber may be positioned; and a plug member positioned between the support member and the container insert, the plug member being configured to prevent passage between the support member and the container insert of a material which may be positioned in the material chamber. The support member is engaged with the driving member and movable in the material chamber in response to rotation of the driving member relative to the container insert and the number of ridges limit rotation of the support member relative to the container insert.

In one form, the number of ridges further limit rotation of the plug member relative to the container insert.

In another form, the support member and the plug member are coupled together by one or more of an adhesive material positioned therebetween and a press fit arrangement.

In yet another form, the support member includes a plurality of apertures extending therethrough and communicating with a portion of plug member.

In one aspect, the portion of the plug member is one of a surface of the plug member positioned adjacent to the support member and a cavity defined by the plug member.

In another form, the plug member includes a central portion positioned adjacent to the support member opposite of the support surface and a lateral edge engaging against the container insert.

In one aspect, the plug member includes a peripheral sidewall extending from the central portion past the support surface of the support member, and the lateral edge is laterally offset from the peripheral sidewall.

In another form, the container system further includes a blocking member positioned around the driving member and between the plug member and an end wall of the container insert.

In yet another form, the plug member includes a peripheral sidewall, an interior sidewall spaced inwardly of the peripheral sidewall, and a cavity positioned between the peripheral sidewall and the interior sidewall.

In one aspect, the support member includes a number of apertures extending therethrough and at least partially positioned over the cavity of the plug member.

In a further aspect, an upper surface of the interior sidewall is positioned on a side of the support member opposite of the support surface of the support member and an upper portion of the peripheral sidewall extends above the support surface.

In another aspect, the internal sidewall of the plug member extends around an opening through which a portion of the support member is positioned.

In still another aspect, the container system further includes a blocking member positioned around the driving member and between the plug member and an end wall of the container insert.

In another embodiment, a container system includes a container insert including a material chamber; a driving member engaged with and rotatable relative to the container insert; a support member positioned in the material chamber and including a support surface on which a material in the material chamber may be positioned; and a plug member positioned between the support member and the container insert, the plug member being configured to prevent passage between the support member and the container insert of a material which may be positioned in the material chamber. The support member is engaged with the driving member and movable in the material chamber in response to rotation of the driving member relative to the container insert.

In one form, the support member includes a plurality of apertures extending therethrough and into communication with a surface of the plug member.

In another form, the support member includes a plurality of apertures extending therethrough and into communication with a cavity defined by the plug member.

In yet another form, the container system further includes a blocking member positioned around the driving member and between the plug member and an end wall of the container insert.

In another form, the plug member includes a peripheral sidewall, an interior sidewall spaced inwardly of the peripheral sidewall, and a cavity positioned between the peripheral sidewall and the interior sidewall.

In one aspect, the support member includes a number of apertures extending therethrough and at least partially positioned over the cavity of the plug member.

In still another aspect, an upper surface of the interior sidewall is positioned on a side of the support member opposite of the support surface of the support member and an upper portion of the peripheral sidewall extends above the support surface.

In yet another aspect, the internal sidewall of the plug member extends around an opening through which a portion of the support member is positioned.

In still another aspect, the container system further includes a blocking member positioned around the driving member and between the plug member and an end wall of the container insert.

In another form, the plug member includes a stem defining an elongated receptacle configured to receive a portion of the support member and a portion of the driving member.

Unless specific arrangements described herein are mutually exclusive with one another, the various implementations described herein can be combined to enhance system functionality or to produce complementary functions. Likewise, aspects of the implementations may be implemented in standalone arrangements. Thus, the above description has been given by way of example only and modification in detail may be made within the scope of the present invention.

With respect to the use of substantially any plural or singular terms herein, those having skill in the art can translate from the plural to the singular or from the singular to the plural as is appropriate to the context or application. The various singular/plural permutations may be expressly set forth herein for sake of clarity. A reference to an element in the singular is not intended to mean "one and only one" unless specifically stated, but rather "one or more." Moreover, nothing disclosed herein is intended to be dedicated to the public regardless of whether such disclosure is explicitly recited in the above description.

In general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). Furthermore, in those instances where a convention analogous to "at least one of A, B, and C, etc." is used, in general, such a construction is intended in the sense one having skill in the art would understand the convention (e.g., "a system having at least one of A, B, and C" would include but not be limited to systems that include A alone, B alone, C alone, A and B together, A and C together, B and C together, or A, B, and C together, etc.). Also, a phrase presenting two or more alternative terms, whether in the description, claims, or drawings, should be understood to include one of the terms, either of the terms, or both terms. For example, the phrase "A or B" will be understood to include the possibilities of "A" or "B" or "A and B."

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A container system, comprising:

a container insert including a chamber and a number of elongated projections extending into the chamber;

a driving member engaged with and rotatable relative to the container insert;

a support member positioned in the chamber and including a number of receptacles each corresponding to a respective one of the number of elongated projections;

a plug member configured to prevent passage of a material in the chamber between the support member and the container insert; and an outer container including a container body extending between a first end and an opposite second end, the container body including a hollow interior communicating with an opening at the first end of the container body and configured to receive the container insert, wherein the container insert includes a generally cylindrical portion and an out-of-round portion positioned adjacent to the generally cylindrical portion and the out-of-round portion is enlarged relative to the generally cylindrical portion and configured to engage with a portion of the container body when the container insert is positioned in the hollow interior of the container body to provide a press fit between the container body and the container insert;

wherein the support member is engaged with the driving member and movable in the chamber in response to rotation of the driving member relative to the container insert and the number of elongated projections limit rotation of the support member relative to the container insert.

2. The container system of claim 1, wherein the plug member is positioned between at least a portion of the support member and the container insert.

3. The container system of claim 2, wherein the support member includes a plurality of apertures extending therethrough and into communication with a cavity defined by the plug member.

4. The container system of claim 3, further comprising a blocking member positioned around the driving member and between the plug member and an end wall of the container insert.

5. The container system of claim 2, wherein the plug member includes a receptacle configured to receive a portion of the support member and provide a press fit arrangement between the plug member and the support member.

6. The container system of claim 1, wherein the plug member includes a number of engagement portions each configured to cooperate with a respective one of the number of elongated projections and a respective one of the number of receptacles of the support member.

7. The container system of claim 6, wherein each of the number of engagement portions includes a convex surface and a concave surface, the convex surface being configured to be positioned in a receptacle of the support member and the concave surface being configured to receive a respective one of the elongated projections.

8. The container system of claim 1, wherein the plug member is formed of a paper material.

9. The container system of claim 1, wherein the outer container includes a rotation member configured to engage with a portion of the driving member extending from container insert, wherein the driving member is rotatable in response to rotation of the rotation member.

10. A container system, comprising:

a container insert including a chamber and a number of ridges positioned along the material chamber;

a driving member engaged with and rotatable relative to the container insert;

a support member positioned in the chamber and including a support surface on which a material in the chamber may be positioned;

a plug member positioned between the support member and the container insert, the plug member being configured to prevent passage between the support member and the container insert of the material which may be positioned in the chamber; and an outer container including a container body extending between a first end and an opposite second end, the container body including a hollow interior communicating with an opening at the first end of the container body and configured to receive the container insert, wherein the container insert includes a generally cylindrical portion and an out-of-round portion positioned adjacent to the generally cylindrical portion and the out-of-round portion is enlarged relative to the generally cylindrical portion and configured to engage with a portion of the container body when the container insert is positioned in the hollow interior of the container body to provide a press fit between the container body and the container insert;

wherein the support member is engaged with the driving member and movable in the chamber in response to rotation of the driving member relative to the container insert and the number of ridges limit rotation of the support member relative to the container insert.

11. The container system of claim 10, further comprising a blocking member positioned around the driving member and between the plug member and an end wall of the container insert.

12. The container system of claim 10, wherein the plug member includes a peripheral sidewall, an interior sidewall spaced inwardly of the peripheral sidewall, and a cavity positioned between the peripheral sidewall and the interior sidewall.

13. The container system of claim 12, wherein the support member includes a number of apertures extending therethrough and at least partially positioned over the cavity of the plug member.

14. The container system of claim 12, wherein an upper surface of the interior sidewall is positioned on a side of the support member opposite of the support surface of the support member and an upper portion of the peripheral sidewall extends above the support surface.

15. The container system of claim 12, wherein the interior sidewall of the plug member extends around an opening through which a portion of the support member is positioned.

16. The container system of claim 15, further comprising a blocking member positioned around the driving member and between the plug member and an end wall of the container insert.

17. A container system, comprising:

a container insert including a chamber;

a driving member engaged with and rotatable relative to the container insert;

a support member positioned in the chamber and including a support surface on which a material in the chamber may be positioned;

a plug member positioned between the support member and the container insert, the plug member being configured to prevent passage between the support member and the container insert of the material which may be positioned in the chamber; and an outer container including a container body extending between a first end and an opposite second end, the container body including a hollow interior communicating with an opening at the first end of the container body and configured to receive the container insert, wherein the container insert includes a generally cylindrical portion and an out-of-round portion positioned adjacent to the generally cylindrical portion and the out-of-round portion is enlarged relative to the generally cylindrical portion and configured to engage with a portion of the container body when the container insert is positioned in the hollow interior of the container body to provide a press fit between the container body and the container insert;

wherein the support member is engaged with the driving member and movable in the chamber in response to rotation of the driving member relative to the container insert.

18. The container system of claim 17, further comprising a blocking member positioned around the driving member and between the plug member and an end wall of the container insert.

19. The container system of claim 17, wherein the plug member includes a peripheral sidewall, an interior sidewall spaced inwardly of the peripheral sidewall, and a cavity positioned between the peripheral sidewall and the interior sidewall.

20. The container system of claim 19, wherein the support member includes a number of apertures extending therethrough and at least partially positioned over the cavity of the plug member.

21. The container system of claim 20, wherein an upper surface of the interior sidewall is positioned on a side of the support member opposite of the support surface of the support member and an upper portion of the peripheral sidewall extends above the support surface.

22. The container system of claim 19, wherein the interior sidewall of the plug member extends around an opening through which a portion of the support member is positioned.

23. The container system of claim 19, further comprising a blocking member positioned around the driving member and between the plug member and an end wall of the container insert.

24. The container system of claim 17, wherein the plug member includes a stem defining an elongated receptacle configured to receive a portion of the support member and a portion of the driving member.

* * * * *